US010357082B2

(12) United States Patent
Liu

(10) Patent No.: US 10,357,082 B2
(45) Date of Patent: Jul. 23, 2019

(54) BELT BUCKLE

(71) Applicant: PURPLE CHAIN IND CO., LTD., Changhua County (TW)

(72) Inventor: Steven Liu, Changhua County (TW)

(73) Assignee: PURPLE CHAIN IND CO., LTD., Changhua County (TW)

( * ) Notice: Subject to any disclaimer, the term of this patent is extended or adjusted under 35 U.S.C. 154(b) by 0 days.

(21) Appl. No.: 15/851,657

(22) Filed: Dec. 21, 2017

(65) Prior Publication Data

US 2019/0191825 A1 Jun. 27, 2019

(51) Int. Cl.
*A44B 11/24* (2006.01)
*A44B 11/00* (2006.01)

(52) U.S. Cl.
CPC ..... *A44B 11/24* (2013.01); *A44B 11/006* (2013.01)

(58) Field of Classification Search
CPC ..... A44B 11/24; A44B 11/006
See application file for complete search history.

(56) References Cited

U.S. PATENT DOCUMENTS 3,181,215 A * 5/1965 Eberhart ..... A44B 11/2526 24/637
5,806,145 A * 9/1998 Chen ..... A44B 11/14 24/170
6,374,464 B1 * 4/2002 Lai ..... A43C 11/1406 24/68 SK
9,155,359 B1 * 10/2015 Bailey ..... A43C 11/146
9,914,385 B1 * 3/2018 Stuckey ..... B60P 7/06
2007/0130735 A1 * 6/2007 Diamond ..... A44B 11/24 24/636
2013/0104354 A1 * 5/2013 Miller ..... B60P 7/0823 24/68 CD
2017/0020234 A1 * 1/2017 Taylor ..... A44B 11/005

* cited by examiner

*Primary Examiner* — Robert Sandy
*Assistant Examiner* — David M Upchurch
(74) *Attorney, Agent, or Firm* — Bruce Stone LLP; Joseph Bruce

(57) ABSTRACT

A belt buckle provided includes: a hollow retaining member including an entry end and an opposite exit end; a rotary member pivotally connected to two ears of the exit end and including a recess, a pulling portion protrudes from one side of the recess, an engaging portion is formed at an opposite another side of the recess, and an abutting portion is provided on an outer surface of the rotary member; a pivot disposed in the recess and having two ends inserted through the ears; a spring sleeved onto the pivot and disposed in the recess to push the abutting portion towards the two ears of the exit end; and an engaging member pivotally attached to the two ears of the entry end.

4 Claims, 8 Drawing Sheets

BELT BUCKLE

BACKGROUND

Field of the Invention

The present invention relates to a belt, and more particularly to a belt buckle capable of simplifying manufacturing process.

Related Prior Art

As shown in FIG. 1, a conventional belt buckle comprises a body 1 and a locking device 2 pivotally connected to the body 1. The locking device 2 includes a pulling member 201 and an engaging member 202. In the pulling member 201 are provided a pivot 203 and a spring 204. The locking device 2 is provided on two opposite lateral walls thereof with two insertion holes 205 for insertion of the pivot 203. The pulling member 201 is pivotally disposed between the two insertion holes 205 of the locking device 2 by the locking device 2. The engaging member 202 is disposed in the locking device 2 and located at one side of the pulling member 201. The engaging member 202 is provided with a ratchet portion 206 for fixing the belt to a desired position. The pulling member 201 is provided with a recess 207, and two apertures 208 are formed at both ends of the pulling member 201 and aligned with the insertion holes 205 for insertion of the pivot 203. Two ends of the pivot 203 are inserted through the apertures 208 of the pulling member 201 and the insertion holes 205 of the locking device 2, and then pressed flat to fix the pivot 203 to the locking device 2. The spring 204 is sleeved onto the pivot 203.

However, assembling the pulling member 201 and the engaging member 202 sequentially at the same side of the locking device 2 increases not only manufacturing complexity but the manufacturing cost as well. Once the belt buckle is produced carelessly, rejection rate will be increased.

The present invention has arisen to mitigate and/or obviate the afore-described disadvantages.

SUMMARY

One objective of the present invention is to provide a belt buckle with simple structure, so as to simplify manufacturing process and improve yield rate.

To achieve the above objective, a belt buckle provided by the invention comprises:

a hollow retaining member including an entry end and an opposite exit end, each of the exit end and the entry end being provided with two opposite ears, and each of the ears being provided with a pivot-insertion aperture;

a rotary member pivotally connected to the two ears of the exit end, and including a recess facing towards the hollow retaining member, and two pivot-insertion holes in communication with the recess and aligned with the two pivot-insertion apertures, wherein a pulling portion protrudes from one side of the recess, an engaging portion which is driven to move by the pulling portion is formed at an opposite another side of the recess, and an abutting portion which is driven by the pulling portion to pivot synchronously with the engaging portion is provided on an outer surface of the rotary member;

a pivot disposed in the recess and having two ends inserted through the pivot-insertion apertures and the pivot-insertion holes;

a spring sleeved onto the pivot and disposed in the recess to push the abutting portion towards the two ears of the exit end; and an engaging member pivotally attached to the two ears of the entry end.

Preferably, the engaging member includes a pivot portion pivotally disposed at the entry end, and a rotary portion which is located opposite the pivot portion and provided at two ends thereof with two pin-insertion apertures.

Preferably, the locking member includes an assembling portion pivotally connected the rotary portion, the assembling portion is provided with an assembling hole aligned with the two pin-insertion apertures, and a plurality of teeth protruding from an outer surface of the assembling portion.

Preferably, a positioning pin is inserted through the assembling hole and the pin-insertion apertures.

Preferably, the exit end of the hollow retaining member is provided with a stop portion protruding towards the entry end, and the stop portion is located opposite the engaging portion.

The invention has the following advantages: the hollow retaining member has two ends pivotally connected to the rotary member and the engaging member, so that the belt can be fixed to one end of the hollow retaining member, and when adjusted to a desired position, another end of the hollow retaining member can restrict the position of the belt. By such arrangement, the structure of the invention is simplified, and the space between the engaging member and the hollow retaining member is reduced. Hence, the length of the invention is shortened, as compared with the conventional belt buckle, which simplifies assembly process, and reduces assembly time and rejection rate.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

DETAILED DESCRIPTION

The present invention will be clearer from the following description when viewed together with the accompanying drawings, which show, for purpose of illustrations only, the preferred embodiment in accordance with the present invention.

Figure 1:
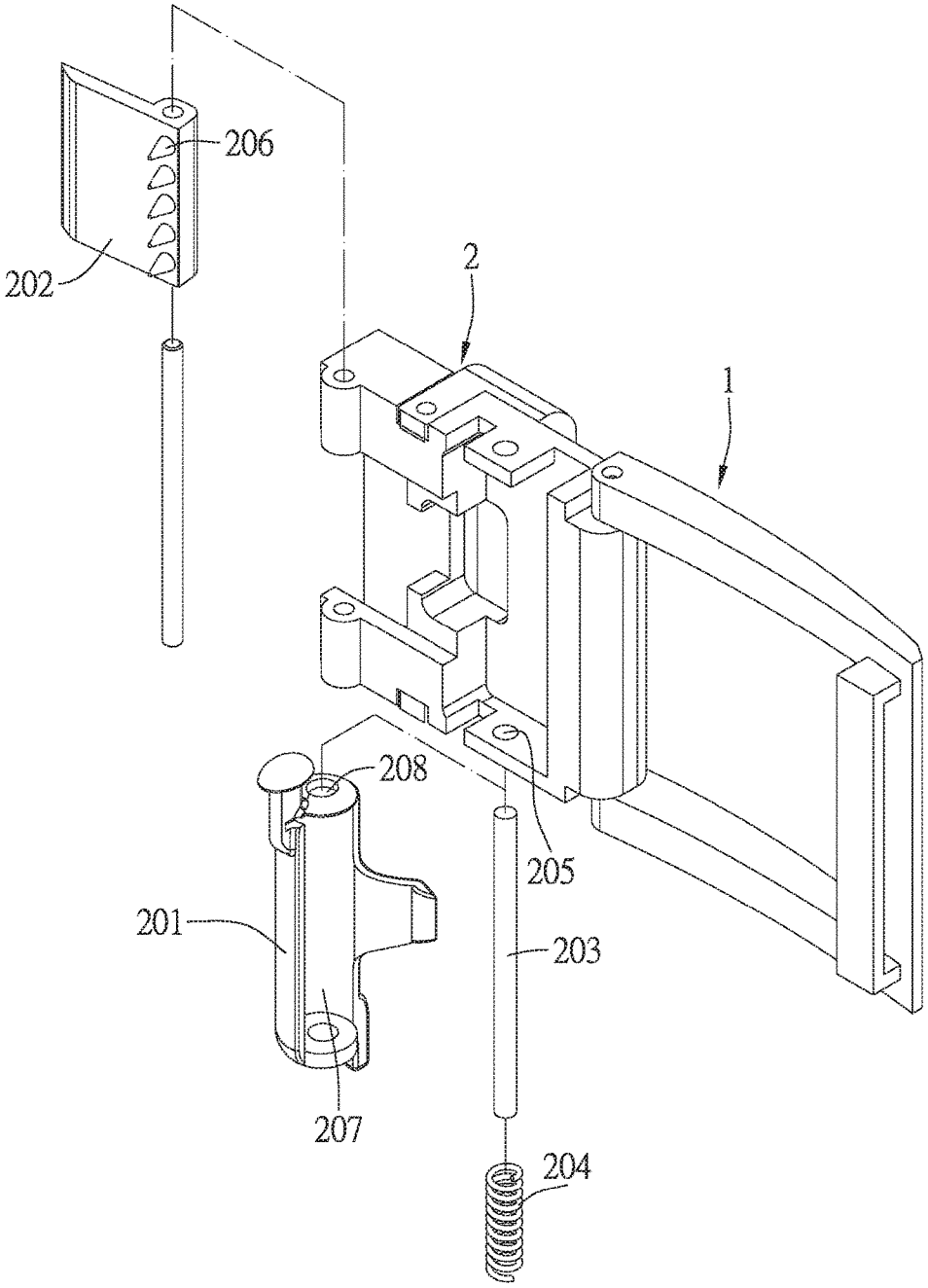
PRIOR ART FIG.1
FIG. 1 is an exploded view of a conventional belt buckle.
Figure 2:
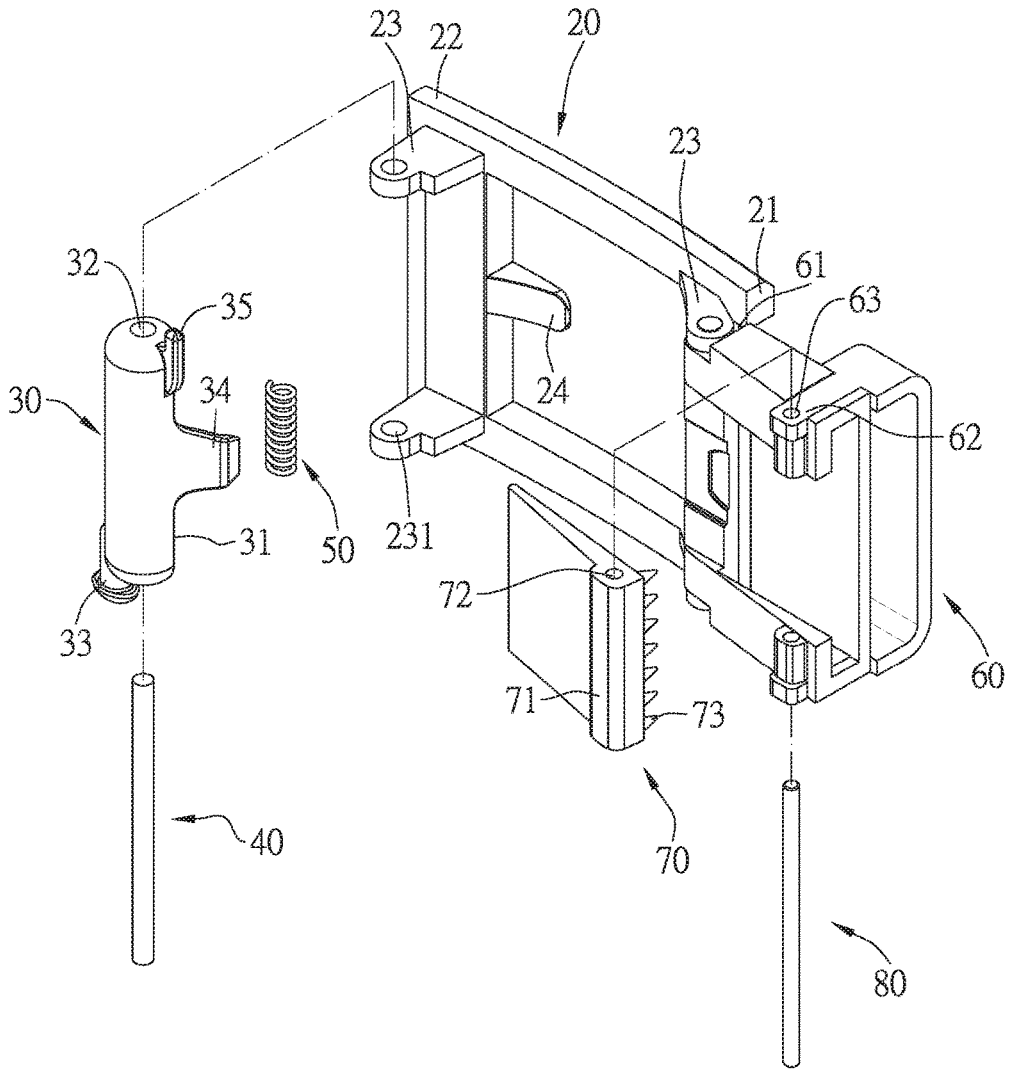
FIG. 2 is an exploded view of a belt buckle in accordance with a preferred embodiment of the invention.
Figure 3:
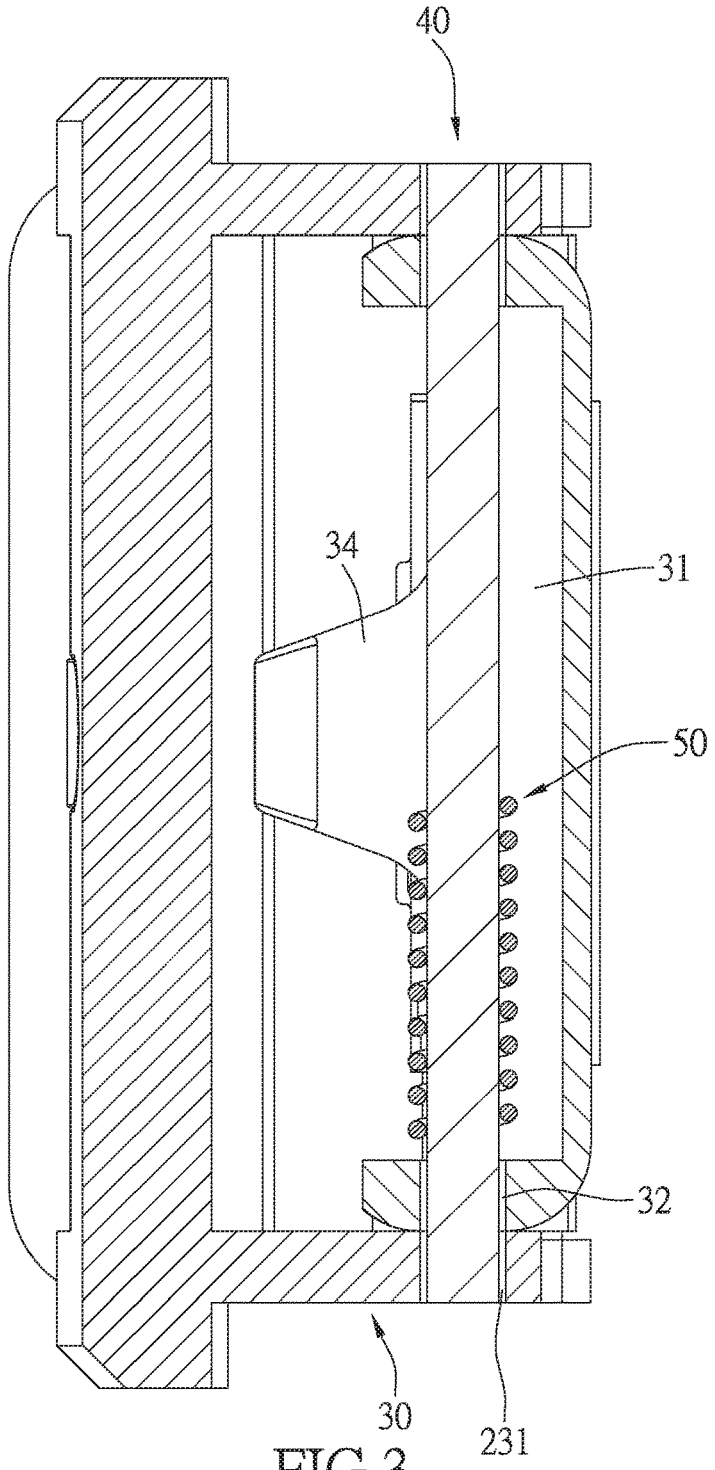
FIG. 3 is a cross sectional view of the belt buckle in accordance with the preferred embodiment of the invention.

Referring to FIGS. 2 and 3, a belt buckle in accordance with the preferred embodiment of the invention comprises: a hollow retaining member 20, a rotary member 30, a pivot 40, a spring 50, an engaging member 60, a locking member 70 and a positioning pin 80.

The hollow retaining member 20 includes an entry end 21 and an opposite exit end 22. Each of the exit end 22 and the entry end 21 is provided with two opposite ears 23, and each of the ears 23 is provided with a pivot-insertion aperture 231. The exit end 22 is provided with a stop portion 24 protruding towards the entry end 21.

The rotary member 30 is pivotally connected to the two ears 23 of the exit end 22, and includes a recess 31 facing towards the hollow retaining member 20, and two pivot-insertion holes 32 in communication with the recess 31 and aligned with the two apertures 231. A pulling portion 33 protrudes from one side of the recess 31, an engaging portion 34 which can be driven to move by the pulling portion 33 is formed at an opposite another side of the recess 31 and located opposite the stop portion 24, and an abutting portion 35 which can be driven by the pulling portion 33 to pivot synchronously with the engaging portion 34 is provided on the outer surface of the rotary member 30.

The pivot 40 is disposed in the recess 31 and has two ends inserted through the pivot-insertion apertures 231 and the pivot-insertion holes 32. The rotary member 30 is pivotally connected to the hollow retaining member 20 by the pivot 40.

The spring 50 is sleeved onto the pivot 40 and disposed in the recess 31 to push the abutting portion 35 towards the two ears 23, so that the abutting portion 35 can be pushed by the spring 50 to abut against the two ears 23 in a unidirectional manner so as to lock the rotary member 30 automatically.

Figure 4:
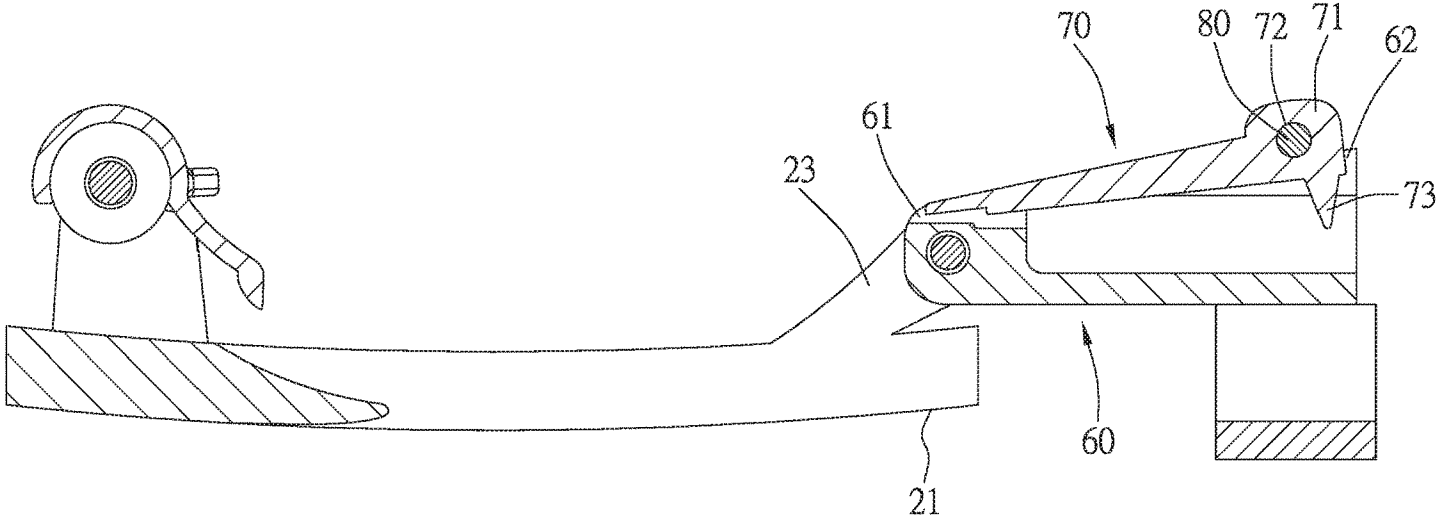
FIG. 4 is a side view of a belt buckle in accordance with a second preferred embodiment of the invention.

Referring to FIGS. 2 and 4, the engaging member 60 is pivotally attached to the two ears 23 of the entry end 21, and includes a pivot portion 61 pivotally disposed at the entry end 21, and a rotary portion 62 opposite the pivot portion 61. The rotary portion 62 is provided at two ends thereof with two pin-insertion apertures 63. The locking member 70 includes an assembling portion 71 pivotally connected the rotary portion 62. The assembling portion 71 is provided with an assembling hole 72 aligned with the two pin-insertion apertures 63, and a plurality of teeth 73 protrude from an outer surface of the assembling portion 71 and are used to press against a belt (not shown), so as to fix the belt buckle to the belt. The positioning pin 80 is inserted through the assembling hole 72 and the pin-insertion apertures 63, so that the locking member 70 is pivotally connected to the engaging member 60.

Figure 5:
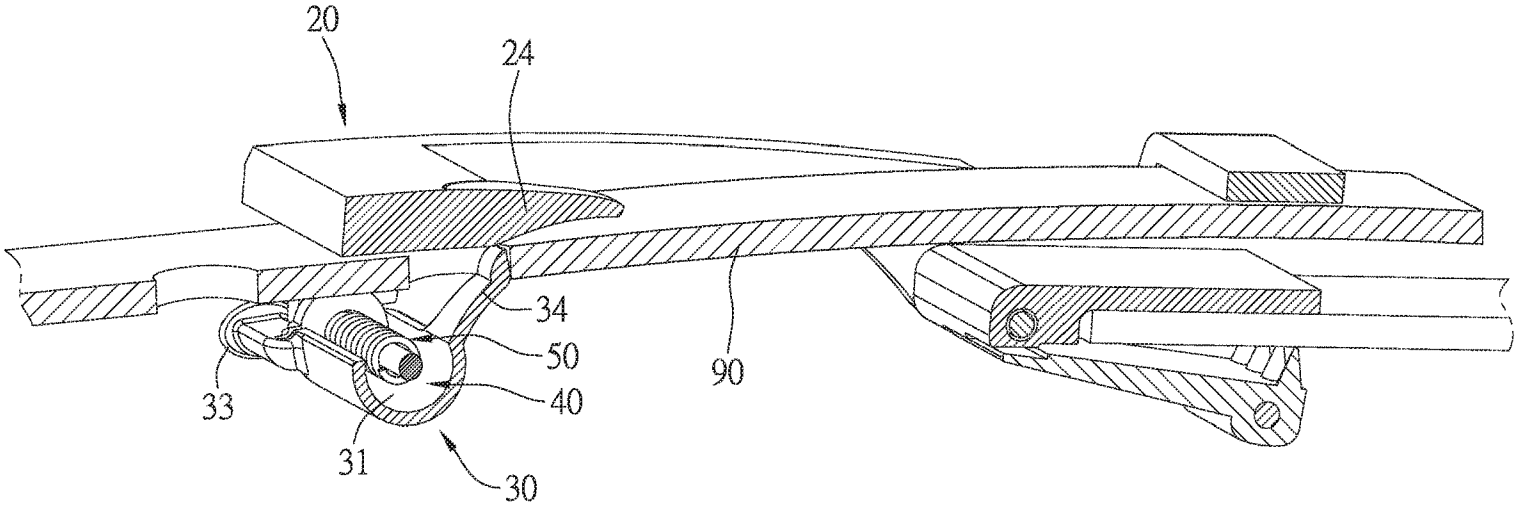
FIG. 5 is an illustrative view of the invention showing that the engaging portion is engaged in the belt.
Figure 6:
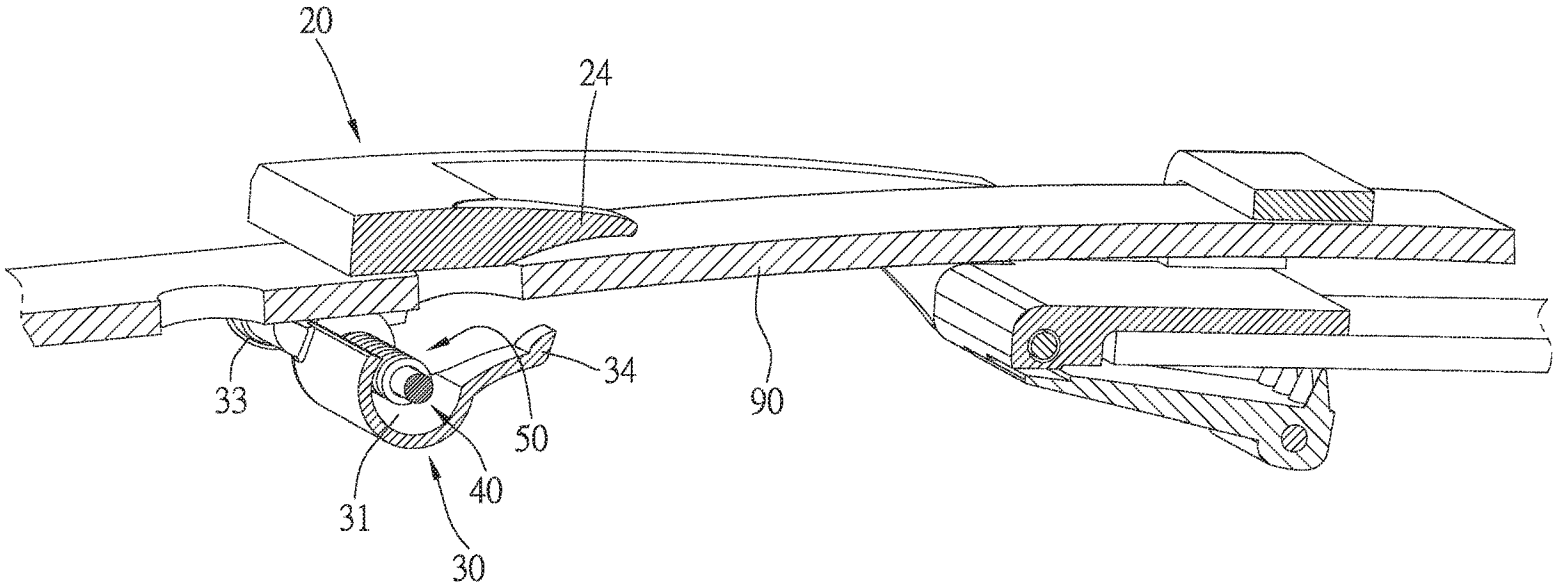
FIG. 6 is an illustrative view of the invention showing that the engaging portion disengages from the belt.

Referring then to FIGS. 5 and 6, when in use, pressing the pulling portion 33 of the rotary member 30 can rotate the recess 31 about the pivot 40 until the engaging portion 34 moves away from the stop portion 24 to an upward open position. When the belt buckle is inserted on a belt 90, pressing the pulling portion 33 can disengage the engaging portion 34 from the belt 90, and at this moment, the spring 50 is compressed. Contrarily, when the pulling portion 33 is released, the rotary member 30 will be pushed by the spring 50 to return to its original position, so that the engaging portion 34 rotates towards the stop portion 24 and engage in the belt 90.

Figure 7:
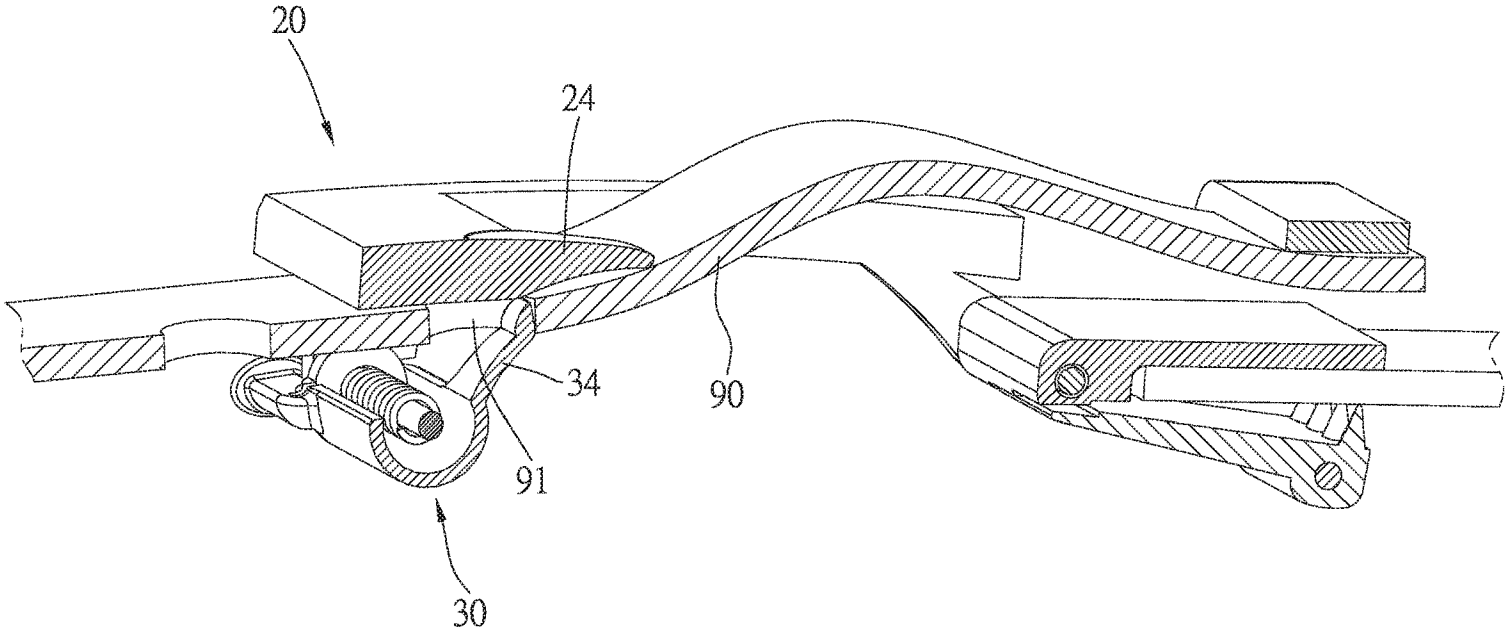
FIG. 7 is an illustrative view of the invention showing that the stop portion and the engaging portion clamp against the belt from both sides.
Figure 8:
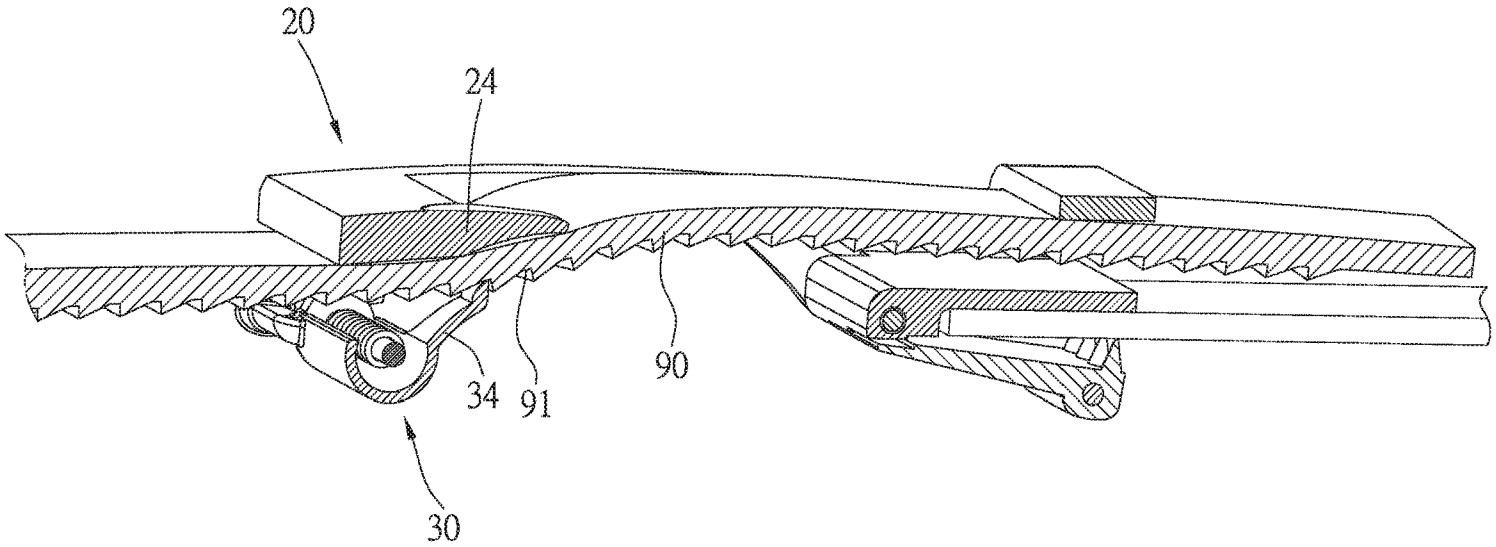
FIG. 8 is an illustrative view of the invention showing that the stop portion and the engaging portion clamp against another belt from both sides.

Referring then to FIGS. 7 and 8, the belt buckle of the invention is suitable for any belt 90, and the engaging portion 34 is engaged in one of the grooves 91 formed in an inner surface of the belt 90 to restrict the position of the belt 90. At this moment, the stop portion 24 also stops against the outer surface of the belt 90, so as to improve the positioning and position restricting function. As compared with the prior art, not only the structure of the belt buckle of the invention is simplified, but also the clamping effect of the belt buckle clamping the belt is improved when the engaging portion 34 and the stop portion 24 clamp against both inner and outer surfaces of the belt 90.

What mentioned above are the structures of the respective components of the invention.

To summarize, the invention has the following advantages: the hollow retaining member 20 has two ends pivotally connected to the rotary member 30 and the engaging member 60, so that the belt 90 can be fixed to one end of the hollow retaining member 20, and when adjusted to a desired position, another end of the hollow retaining member 20 can restrict the position of the belt 90. By such arrangement, the structure of the invention is simplified, and the space between the engaging member 60 and the hollow retaining member 20 is reduced. Hence, the length of the invention is shortened, as compared with the conventional belt buckle, which simplifies assembly process, and reduces assembly time and rejection rate.

While we have shown and described various embodiments in accordance with the present invention, it is clear to those skilled in the art that further embodiments may be made without departing from the scope of the present invention.

What is claimed is:

1. A belt buckle comprising:

a hollow retaining member including an entry end and an opposite exit end, each of the exit end and the entry end being provided with two opposite ears, and each of the ears being provided with a pivot-insertion aperture;

a rotary member pivotally connected to the two ears of the exit end, and including a recess facing towards the hollow retaining member, and two pivot-insertion holes in communication with the recess and aligned with the two pivot-insertion apertures, wherein a pulling portion protrudes from one side of the recess, an engaging portion which is driven to move by the pulling portion is formed at an opposite another side of the recess, and an abutting portion which is driven by the pulling portion to pivot synchronously with the engaging portion is provided on an outer surface of the rotary member;

a pivot disposed in the recess and having two ends inserted through the pivot-insertion apertures and the pivot-insertion holes;

a spring sleeved onto the pivot and disposed in the recess to push the abutting portion towards the two ears of the exit end; and an engaging member pivotally attached to the two ears of the entry end;

wherein the engaging member includes a pivot portion pivotally disposed at the entry end, and a rotary portion which is located opposite the pivot portion and provided at two ends thereof with two pin-insertion apertures.

2. The belt buckle as claimed in claim 1 further comprising a locking member which includes an assembling portion pivotally connected the rotary portion, the assembling portion is provided with an assembling hole aligned with the two pin-insertion apertures, and a plurality of teeth protruding from an outer surface of the assembling portion.

3. The belt buckle as claimed in claim 2 further comprising a positioning pin inserted through the assembling hole and the pin-insertion apertures.

4. The belt buckle as claimed in claim 1, wherein the exit end of the hollow retaining member is provided with a stop portion protruding towards the entry end, and the stop portion is located opposite the engaging portion.

* * * * *